US005555923A

United States Patent [19]

Leist et al.

[11] Patent Number: 5,555,923

[45] Date of Patent: Sep. 17, 1996

[54] SECTIONAL DOOR HAVING MULTIPLE PIECE PANEL SECTIONS

[75] Inventors: Alan R. Leist, Cincinnati; Richard J. Lewis, Jr., Loveland; William J. Sachs, Jr., Cincinnati, all of Ohio

[73] Assignee: Clopay Building Products Company, Inc., Cincinnati, Ohio

[21] Appl. No.: 361,994

[22] Filed: Dec. 21, 1994

Related U.S. Application Data

[63] Continuation-in-part of Ser. No. 241,288, May 11, 1994.

[51] Int. Cl.[6] ..... E06B 3/48

[52] U.S. Cl. ..... 160/229.1; 160/236; 49/501; 52/582.1; 52/802.1

[58] Field of Search ..... 160/201, 229.1, 160/232, 235, 236, 405; 52/71, 802.1, 582.1, 583.1, 223.7; 49/501

[56] References Cited

U.S. PATENT DOCUMENTS

| | | |
|---|---|---|
| 36,427 | 9/1862 | Shaefer . |
| 656,741 | 8/1900 | Leaver . |
| 1,983,098 | 11/1931 | Pixley . |
| 2,061,304 | 11/1936 | Graham . |
| 2,948,956 | 8/1960 | Colombini . |
| 2,951,533 | 9/1960 | Lucas et al. . |
| 2,956,314 | 10/1960 | Rowe et al. . |
| 2,959,221 | 11/1960 | Clapsaddle, Jr. . |
| 3,019,867 | 2/1962 | Colombini . |
| 3,178,776 | 4/1965 | Stansberry . |
| 4,702,054 | 10/1987 | Turner . |
| 4,706,431 | 11/1987 | Corvese . |
| 4,984,399 | 1/1991 | Taylor . |
| 5,060,711 | 10/1991 | Fimbell, III . |
| 5,095,675 | 3/1992 | Audia . |
| 5,123,211 | 6/1992 | Schlicht et al. . |
| 5,123,223 | 6/1992 | Makarevich et al. . |
| 5,193,322 | 3/1993 | Wood . |

*Primary Examiner*—David M. Purol
*Attorney, Agent, or Firm*—Wood, Herron & Evans, P.L.L.

[57] ABSTRACT

A sectional door, which may be an overhead door such as a residential garage door, including hingedly connected door panels each being formed from a plurality of subpanels. The subpanels forming each door panel are disposed end-to-end to form the entire length of the door panel. Rigid connection between adjacent subpanels of the same door panel is made by at least one and preferably two connecting bars extending within channels of adjacent subpanels in a lengthwise direction. The connecting bars are each formed of a length substantially less than the overall length of the door panel but slightly longer than the length of an individual subpanel. All components of the door may be stored and transported in relatively small packages or cartons, yet may be assembled into a structurally rigid, wind resistant sectional door.

43 Claims, 4 Drawing Sheets

SECTIONAL DOOR HAVING MULTIPLE PIECE PANEL SECTIONS

This application is a continuation-in-part of co-pending application Ser. No. 08/241,288, filed May 11, 1994.

FIELD OF THE INVENTION

The present invention relates to sectional, hinged doors and, more particularly, to overhead doors comprised of a plurality of hinged door panel sections which fold with respect to each other during opening and closing operations of the door.

BACKGROUND OF THE INVENTION

Typical overhead doors are constructed from a plurality of door panels which are hinged together and supported from a track system with rollers attached to opposite ends of the door panels. The rollers generally allow the door to be moved from a vertically oriented closed position to a substantially horizontal open position. Particularly with regard to residential applications, these doors are generally either eight or sixteen feet wide and are typically comprised of horizontally oriented integrally formed panels which are likewise about eight or sixteen feet long. For example, a single car residential garage may have an eight foot wide door while a two car residential garage may have a single sixteen foot wide door or two eight foot wide doors.

One of the main problems with conventional overhead doors concerns their bulk and inability to be easily and cost efficiently transported to the end user. This is especially true when considering the potential retail market for overhead doors which would include, for example, the market serving small builders, remodelers and homeowners or "do-it-yourselfers". At present, the retail market cannot easily serve the needs of such customers due to the problems inherent in the delivery of the eight or sixteen foot wide overhead door. Similarly, "do-it-yourselfers" often avoid the task of installing or replacing overhead doors themselves because of the bulk of the lengthy door panels as well as the unavailability of overhead doors in retail outlets.

Attempts have been made to construct overhead door panels with a plurality of component parts, including smaller door panel sections which may be assembled into a single, longer door panel. U.S Pat. No. 1,983,098 to Pixley; U.S. Pat. No. 2,951,533 to Lucas et al.; and, U.S. Pat. No. 5,060,711 to Fimbell disclose various overhead doors having a panel or panels comprising multiple subsections.

The panels disclosed in the above patents, however, have disadvantages associated with their complexity, bulkiness and/or lack of strength. For example, the single sectioned panel disclosed in the Pixley patent uses complicated vertically oriented clamp members which connect two adjacent panel sections. Such clamp members are not aesthetically pleasing to the typical homeowner and would not provide the door with adequate strength or wind resistance, especially if used to construct an entire door.

The doors disclosed in the Lucas et al. and Fimbell patents each comprise panels formed with multiple constituent pieces, however, each of these doors require upper and lower horizontal frame or support members and a plurality of vertical support mullions or struts for connecting panel subsections together. In addition to being complicated structures as a result of all of the supporting frame members, the upper and lower horizontal frame members disclosed in each of these patents are required to be approximately as long as the door is wide. Therefore, for example, in a residential application the horizontal frame members would have to be either eight or sixteen feet long. As a result, just as with doors comprised of one-piece integral door panels, these doors would be difficult to stock and difficult for the average retail consumer to both transport and assemble.

There is a need, therefore, for an overhead door which may be more easily transported and stocked, yet which is aesthetically pleasing and sufficiently strong and wind resistant for a large variety of applications.

SUMMARY OF THE INVENTION

To solve problems which have become apparent in the art, including those problems mentioned above, the present invention provides an multiple-piece, door panel which may be used in a hinged, sectional door. The door panel is rigid and wind resistant but may also be easily stored and transported in broken down form. More specifically, each multiple-piece door panel provides one hinged section of a sectional door and comprises a plurality of rigidly connected subpanels disposed in end to end relationship. Each subpanel thus forms a portion of the overall length of the door panel. When the sectional door is an overhead door, the length of the door panel essentially defines the overall width of the door. Also in accordance with the basic principles of this invention, a plurality of connecting bars are provided to rigidly secure adjacent subpanels together to form the longer door panel. Importantly, all of the connecting bars extend lengthwise between the subpanels but have a length substantially less than the overall length of the door panel. Preferably, the length of each connecting bar is approximately as long as each subpanel such that full length support of each subpanel is achieved while still maintaining the above-mentioned advantage of ready storage, transportation and assembly of the component parts.

In disassembled form, all component parts of either one door panel or multiple door panels may be stored and transported in relatively small cartons or packages which are sufficiently manageable by retail consumers. Such packages may be between two and six feet long and each package may, for example, comprise a kit for assembling one door panel. Multiple subpanels may then be rigidly secured to one another to form a fully unitary door panel and, more particularly, a strong sectional or overhead door comprised of a plurality of such unitary door panels.

In the preferred embodiment, each subpanel includes a base subpanel member having a plurality of connecting bar channels. The channels of adjacent, subpanels disposed end-to-end allow a single connecting bar to be secured to each subpanel and extend therebetween to provide a rigid connection at the junction between the two subpanels. At least one and preferably two channels are provided for each subpanel and two connecting bars are used to connect two subpanels. The channels are preferably tubular inner portions of the subpanels which line up with one another when two subpanels are placed together in end-to-end fashion. One connecting bar extends within each tubular inner portion of each of the adjacent subpanels with a sliding frictional fit a distance equal to at least about half the length of the subpanel. It will therefore be appreciated that the subpanels and connecting bars each include connector portions which allow attachment therebetween. In addition, alignment members are provided for aligning two subpanels end-to-end. These preferably comprise junction caps each being formed with multiple protrusions for fitting within mating recesses of adjacent subpanels.

Preferably, each connecting bar in a particular door panel is secured to at least one adjacent connecting bar. Most preferably, the connecting bars are formed with a length slightly longer than the subpanels and are also sized with respect to one another such that two connecting bars telescopically connect with one another proximate a midpoint along the length of a subpanel. This results in not only a strong connection point at the junction of two connected subpanels, but significant bending strength along the entire length of each subpanel, Because of this latter property of the preferred embodiment of the invention, the base subpanels themselves need not be designed with significant strength properties. Instead, the telescopically attached connecting bars provide the necessary strength and wind resistance properties to each door panel, especially when used in an overhead garage door.

In addition to the subpanel base members and connecting bars, each subpanel may also include various non-load bearing components for aesthetic refinement of the basic structure. In this regard, decorative front panels or "facades" and/or moldings may be provided so that each subpanel includes a surface design which combines with the other subpanels to form an overall door surface which has pleasing aesthetic qualities and which does not substantially reveal that each door panel is constructed of a plurality of individual, connected subpanels. This is especially true in residential garage door applications in which it would not be desirable to have visible seams between adjacent subpanels. As one alternative to the front panel and various moldings specifically disclosed herein for the purpose of providing a decorative or aesthetically pleasing front surface of each panel, it will be appreciated that snap-on front facades of the type disclosed in co-pending and commonly assigned patent application Ser. No. 08/241,288 may be used. The disclosure contained in application Ser. No. 08/241,288 is hereby fully and expressly incorporated by reference herein.

Finally, the present invention further contemplates methods of making a sectional door panel, such as an overhead door panel and a sectional door, such as an overhead door, utilizing the advantageous structure described above. Generally, a method of making a sectional door panel according to the principles of the invention includes the steps of provided subpanels each having a length substantially less than the overall length of the door panel; providing a plurality of connecting bars each also having a length substantially less than the overall length of the door panel; and, rigidly securing multiple subpanels together using at least one connector bar affixed between each adjacent subpanel placed in end-to-end relationship with another subpanel such that multiple connecting bars extend generally lengthwise with the subpanels.

A method of making a sectional door in accordance with the principles of the present invention involves repeating the steps described immediately above to thereby provide a plurality of sectional door panels, each being constructed of multiple subpanels, and then hingedly connecting adjacent door panels together to form a sectional door, such as an overhead door.

From the foregoing, it will be appreciated that the invention provides a strong, wind resistant sectional or overhead door which may be assembly from components which are easily stored or stocked and then transported to the job site in relatively small, manageable cartons or packages. Further advantages and features of the invention will become more apparent upon review of the following detailed description of one preferred embodiment, taken in conjunction with the accompanying drawings.

DETAILED DESCRIPTION OF THE PREFERRED EMBODIMENT

Figure 1:
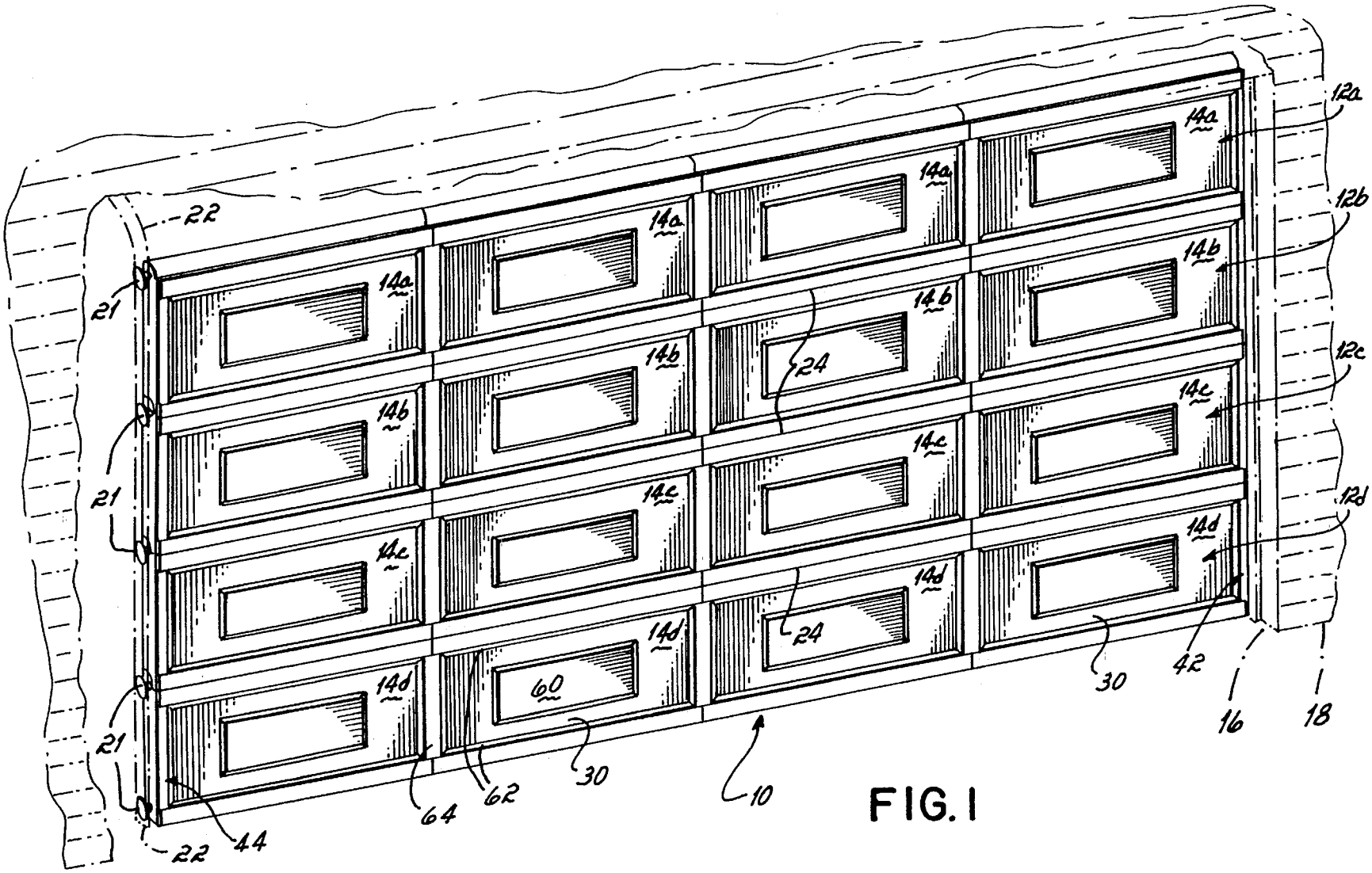
FIG. 1 is a schematic perspective of an overhead garage door incorporating subpanels of the present invention in fully assembled and aesthetically refined form.

FIG. 1 illustrates an overhead sectional door 10, such as residential garage door, which is generally constructed from four door panels 12*a*, 12*b*, 12*c*, 12*d* which are hingedly secured together in a manner to be discussed below. In the illustrated embodiment, door 10 comprises a "double length" garage door which is typically used in a residential application for a two car garage. Thus, each door panel 12*a*, 12*b*, 12*c*, 12*d* is approximately 16 feet long and extends the entire width of door 10. Each door panel 12*a*, 12*b*, 12*c*, 12*d* is comprised of four respective subpanels 14*a*, 14*b*, 14*c*, 14*d*. As shown in FIG. 1, with door 10 in a closed position, the four door panels 12*a*, 12*b*, 12*c*, and 12*d* will be disposed vertically to close door opening 16 of a building structure or garage 18. Although only one set of rollers 21 and one track 22 appear in FIG. 1, each of the door panels 12*a*, 12*b*, 12*c*, 12*d* have rollers on both ends thereof which mount door 10 to a track allowing door 10 to be moved between the closed, vertical position shown in FIG. 1 and an open, horizontal position (not shown) as is conventional. Each door panel 12*a*, 12*b*, 12*c*, 12*d* is attached to an adjacent door panel along a hinge line 24 to allow movement of door 10 between these open and closed positions.

Figure 4:
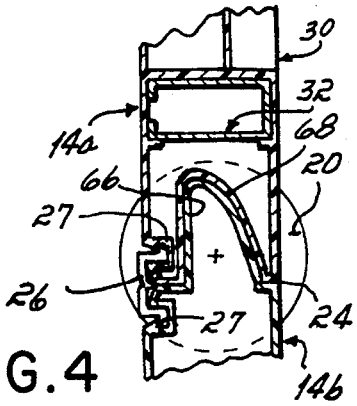
FIG. 4 is a cross section of a hinge joint for adjacent subpanels of different door panels for an assembled overhead sectional door; and, FIG. 5 is a perspective view of a kit including a plurality of door components of the invention contained in a carton or package.

The hinges which are used to connect adjacent door panels may be of any conventional type, however, preferred flexible hinges are described fully in Leist, U.S. Pat. Nos. 4,995,441; 5,054,536; and 5,129,441, which are assigned to the assignee of the present invention and the disclosures are which incorporated herein by reference. A preferred flexible hinge 26 is shown in FIG. 4 and is configured to be securely mounted within respective notches or recesses 27 of relative upper and lower adjacent door panels 12*a*, 12*b*, of which only one subpanel 14*a*, 14*b* of each is shown in FIG. 4. It is to be understood that identical joints and hinges 27 are contained between adjacent door panels 12*b*, 12*c* and 12*c*, 12*d* at hinge lines 24 shown in FIG. 1.

It will be appreciated that each of the subpanels 14*a*, 14*b*, 14*c*, 14*d* are approximately four feet in length such that the aggregate of four subpanels equals the length of, for example, a standard 16 foot sectional door panel. Using the same principles to be described herein, a single eight foot wide door may be constructed from a plurality of eight foot long door panels each comprising two subpanels which are each four feet long or, for example, four subpanels which are each two feet long. Other numbers and lengths of subpanels may be used as is suitable for the application needs. It is contemplated that a convenient range of lengths for the subpanels will be between about two and six feet. This range retains both the practicality and manageability of the subpanels.

Figure 2:
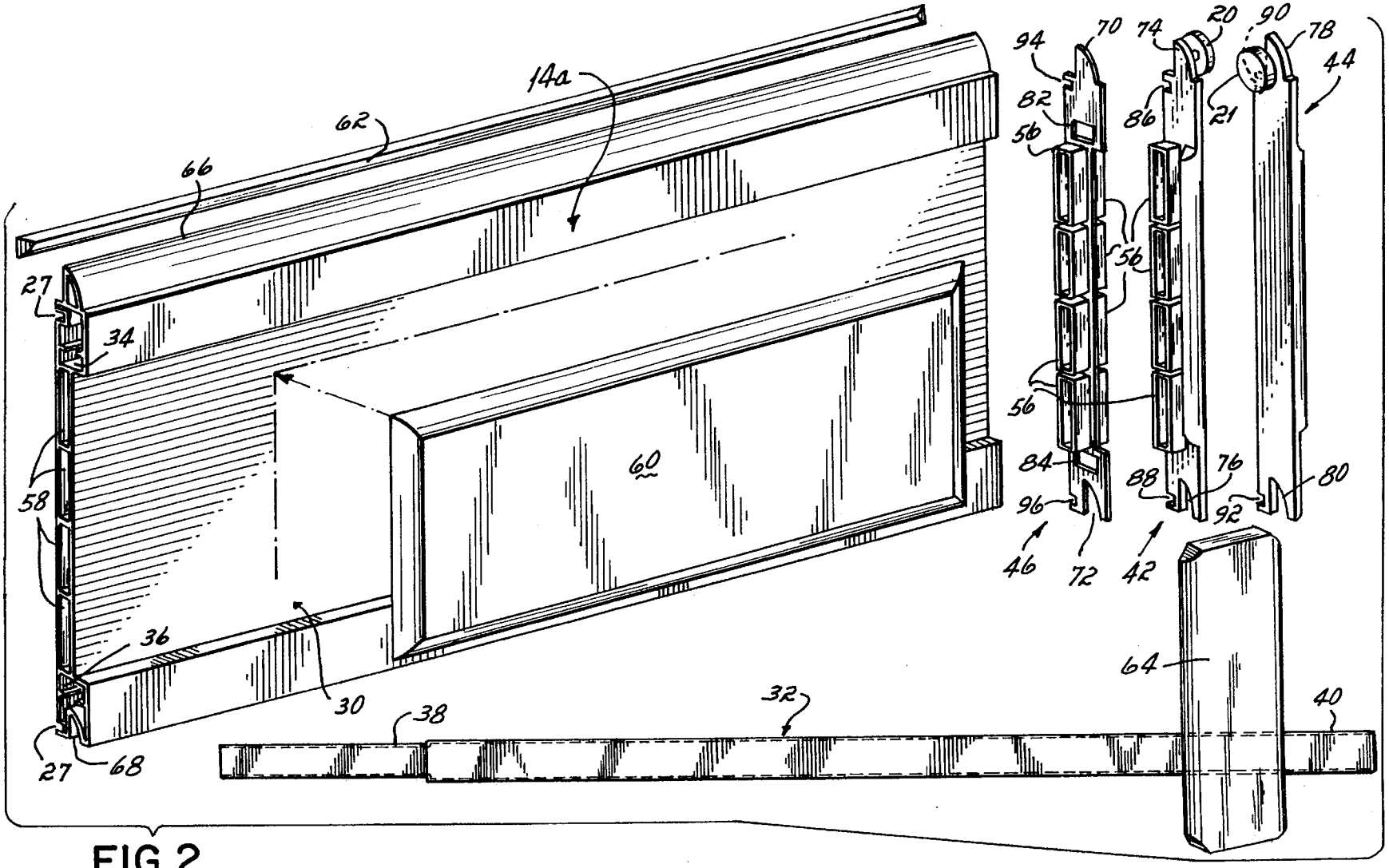
FIG. 2 is a schematic perspective of the basic components, used to construct the subpanels of the present invention as well as to connect the subpanels to form the door of FIG. 1.
Figure 3:
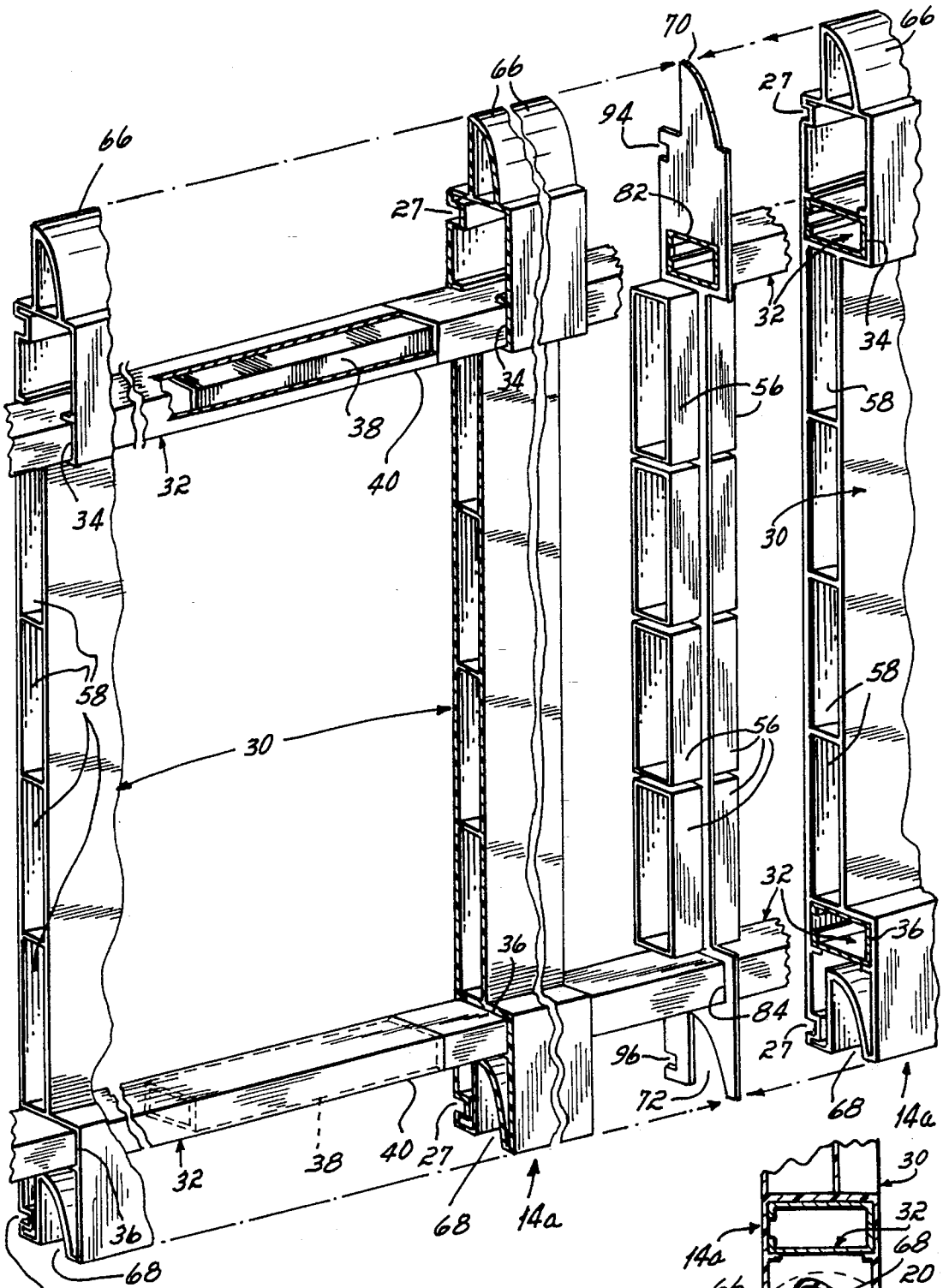
FIG. 3 is fragmented perspective view showing the connection of one subpanel to another.

Turning now to FIG. 2, the basic components used in the construction of subpanels 12*a*, 12*b*, 12*c*, 12*d* is shown in connection with subpanel 14*a*. It will be appreciated that the remaining subpanels 14*b*, 14*c*, 14*d* are constructed in essentially the same manner and therefore, the description of subpanel 14*a* should be understood as also describing the construction of each of the remaining subpanels 14*b*, 14*c*, 14*d*. Subpanel 14*a* includes a base subpanel member 30 which may be rigidly connected to another base subpanel member 30 by two connecting bars 32, only one of which is shown in FIG. 2, which are securely received in respective spaces or tubular inner portions 34, 36 of base subpanel member 30 preferably with a frictional fit as will be described. Each connecting bar 32 is comprised of a portion 38 having a reduced cross sectional area and a portion 40 having a relatively larger cross sectional area. As best shown in FIG. 3, connecting bars 32 are preferably of tubular shape and rectangular cross sectional configuration such that the reduced portion 38 of one connecting bar 32 may be slidably and telescopically inserted into the larger tubular portion 40 of another connecting bar 32 to make the connection between two subpanels 14*a* placed end-to-end.

Referring again to FIG. 2, other general components which are used to either secure two subpanels 14*a* together or to secure and mount one end or another of a subpanel 14*a* to track 22 (FIG. 1) include respective right and left end caps 42, 44, and junction cap 46. Right and left end caps 42, 44 each include respective rollers 20, 21. It will be appreciated that when subpanel 14*a* is used as an end subpanel of door panel 12*a* on the left side of door 10 as viewed in FIG. 1, end cap 44 will be connected to the left end of subpanel 14*a* to supply rollers 21 for mounting the left side of door 10 to track 22. Likewise, when subpanel 14*a* is used as an end subpanel of door panel 12*a* on the righthand side of door 10, end cap 42 will be used to similarly supply rollers 20 for mounting the righthand side of door 10 to a track (not shown). In this regard, end caps 42, 44 connect and function in the same manner as the caps disclosed in related application Ser. No. 08/241,288. In a manner to be detailed below, junction caps 46 are used between adjacent subpanels 14*a* to provide a connecting and alignment function at the junction of two subpanels 14*a* placed end-to-end. To align end caps 42, 44 and junction cap 46 with base subpanel member 30 as well as to make connections therebetween, rectangular protrusions 56 extend from one side of each of the end caps 42, 44 as well as from both sides of junction cap 46. Protrusions 56 of each cap 42, 44 and each junction cap 46 slidably but securely fit within rectangular recesses or channels 58 at the ends of base subpanel member 30.

Components are also preferably provided for creating an aesthetically pleasing look for each of the subpanels. In this regard, the snap-on facades which are detailed and claimed in co-pending application Ser. No. 08/241,288 may be used for creating this pleasing aesthetic appearance. Alternatively, as shown in FIGS. 1 and 2, simpler structure such as front decorative panel 60, molding strips 62 and molding 64 may be used to create an aesthetically pleasing front surface for door 10. Decorative panel 60 and moldings 62 and 64 may each be adhesively secured to base subpanel member 30 in the respective locations shown in FIG. 1 to create a uniform front decorative surface for door 10. Base subpanel member 30, caps 42, 44, 46 and decorative components 60, 62, 64 may all be formed from plastic such as ABS, polycarbonate or polyvinyl chloride, and appropriate, conventional adhesives may be used for securing these components together.

Each base subpanel member is also provided with an upper male joint member 66 and a lower female joint member 68. Junction cap 46 is provided with a corresponding male end 70 and female end 72. End caps 42, 44 also each include respective male and female ends 74, 76, and 78, 80. It will be appreciated that when end caps 42, 44 and junction cap 46 are secured at the appropriate ends of each subpanel 14*a*, 14*b*, 14*c*, 14*d*, the male and female ends thereof form part of the corresponding male joint members 66 or female joint member 68. Junction cap 46 further includes upper and lower rectangular apertures 82, 84 for receiving connecting bar 32 therethrough when two subpanels 14*a* are connected in end-to-end relationship. End caps 42 and 44 each include respective upper and lower notches 86, 88 and 90, 92 for receiving flexible hinge member 26. Junction cap 46 likewise includes upper and lower notches on 94, 96 for the same purpose. As the construction and operation of the joint structure and hinge structure does not form any part of the present invention, the above incorporated Leist patents are relied upon to provide such details. It will be appreciated that other conventional joint designs may be used in place of this joint structure as well.

The rigid connection between two subpanels 14*a* placed in end-to-end relationship will be understood from a review of FIG. 3. In this regard, FIG. 3 illustrates two subpanels 14*a* placed end-to-end with a junction cap 46 disposed therebetween. Rectangular protrusions 56 of junction cap 46 are inserted into mating rectangular channels for recesses 58 at opposed ends of each base subpanel member 30. One connecting bar extends through upper rectangular aperture 82 and junction cap 46 as well as into respective upper receiving spaces or rectangular tubular portions 34 of each base subpanel member 30 and a second connecting bar extends through lower rectangular aperture 84 in junction cap 46 and into the respective lower receiving spaces or rectangular tubular portions 36 of each base subpanel member 30. Connecting bars 32 are preferably sized such that the larger dimensioned portion 40 is received by tubular portion 34 or 36 with a sliding, but snug frictional fit. If desired or necessary, further connecting plates or their similar structure may be fastened across the joint between two subpanels 14*a* to ensure that the subpanels 14*a* do not pull apart at the joint. Such additional connecting structure would not supply significant structural or bending strength, as this is supplied by connecting bars 32.

Each connecting bar 32 is preferably somewhat longer than the length of each subpanel 14*a* such that the reduced portion 38 thereof may be received within the larger tubular portion 40 of the next connecting bar proximate a mid portion of each subpanel 14*a*. For example, the larger tubular portion 40 of each connecting bar may be approximately 4 feet long, thus corresponding to the length of each subpanel 14*a*, 14*b*, 14*c*, 14*d* while reduced portion 38 may be approximately 8 inches long. When two base subpanel members 30, two connecting bars 32 and a junction cap 46 are generally connected and oriented as shown in FIG. 3, rigid connection between adjacent subpanel members 30 is made simply by pushing the two base subpanel members 30 together such that oppositely extending rectangular protrusions 56 of junction cap 46 register within the associated rectangular channels or recesses 58 of each base subpanel member 30.

A review of FIG. 1 will reveal that a 16 foot wide door 10 having four 16 foot long door panels 12*a*, 12*b*, 12*c*, 12*d* each comprised of four 4 foot long subpanels 14*a*, 14*b*, 14*c*, 14*d* will require a minimum of 24 connecting bars 32. That is, upper and lower connecting bars 32 extend across each joint between adjacent, end-to-end subpanels 14*a*, 14*b*, 14*c*, 14*d*. These joints are defined at moldings 64 in the door 10 illustrated in FIG. 1. If necessary or desired, further support bars may be inserted into channels 34 and 36 at opposite ends of each door panel 12*a*, 12*b*, 12*c*, 12*d* and may telescopically or otherwise connect with connecting bars 32. Although this would not be necessary for connecting subpanels together, it may be desirable in order to provide sufficient bending strength along the fully length of the subpanels 14*a*, 14*b*, 14*c*, 14*d* located along opposite ends of door 10.

Figure 5:
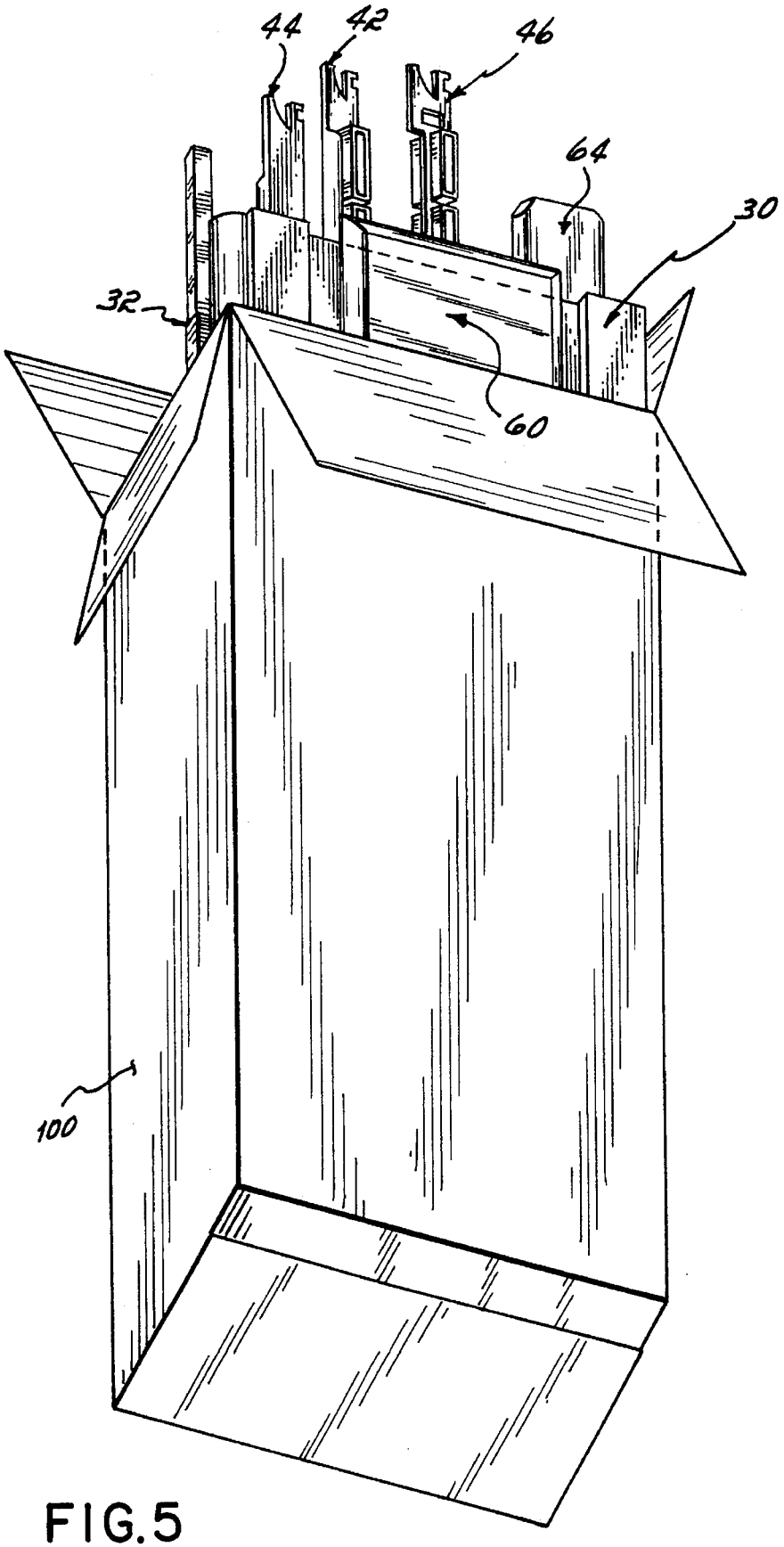

FIG. 5 illustrates the present invention in "kit" form. That is, the components of a sectional door including, but not limited to, subpanels 30, connecting bars 32, end caps 42, 44, junction caps 46, facades 60 and moldings 64 may be conveniently stored and transported in a package, such as carton 100. Such cartons 100 may be conveniently sized to fit within an average sized automobile such that a retail consumer may transport multiple kits 100 home to construct a door 10 (FIG. 1). Each carton might, for example, hold the component parts to one door panel 12*a* (FIG. 1).

By virtue of the foregoing, the present invention therefore provides a sectional door comprised of a plurality of interconnected sections which are rigidly secured together by a minimal number of parts, each being dimensioned to allow easy storage and transportation of the door in its unassembled state but which may be readily assembled into a larger, rigid and aesthetically pleasing sectional door structure.

While the present invention has been illustrated by a detailed description of one preferred embodiment, changes may be made to these details without departing from the concepts of the invention. For example, while the means for attaching the connecting bars to one another has been described as a telescopic connection, it will be understood that other conventional types of connections made with fasteners may be employed instead. Moreover, such connections may not be necessary in many applications, but rather a connection between only the connecting bars and the subpanels may be employed. It is generally preferable that there be some overlap between the ends of adjacent connecting bars such that weak points along the length of the door panel are not present.

As will be appreciated it is not Applicants' intention to be bound by the details of the above detailed description. Rather, the invention in its broadest respects is not limited to these specific details, representative apparatus or illustrative examples shown and described. Accordingly, departures from these details may be made without departing from the spirit or scope of Applicant's general inventive concept.

What is claimed is:

1. A door panel used to form one articulating section of an overhead sectional door, the door panel comprising:

a plurality of subpanels, each subpanel forming a portion of an overall length of said door panel;

a plurality of connecting bars, said connecting bars each having a length substantially less than the overall length of said door panel;

connector portions on each subpanel and each connecting bar for securing said connecting bars to adjacent subpanels placed end-to-end with said connecting bars extending in a lengthwise direction relative to said door panel; and, at least one hinge support disposed at an edge of a least one subpanel for hingedly mounting said door panel to an adjacent door panel.

2. The door panel of claim 1 wherein said connector portions of each subpanel and connecting bar respectively include a channel formed in each subpanel and an outer surface portion of each connecting bar which is received with a sliding frictional fit in said channel.

3. The door panel of claim 2 wherein said subpanels are of approximately equal length and each connecting bar has a length at least approximately equal to the length of a subpanel.

4. The door panel of claim 1 wherein said subpanels are of approximately equal length and each connecting bar has a length at least approximately equal to the length of a subpanel.

5. The door panel of claim 4 wherein each subpanel is between about two and six feet in length.

6. The door panel of claim 1 wherein each subpanel is between about two and six feet in length.

7. The door panel of claim 4 further comprising means for attaching adjacent connecting bars together generally in end-to-end relationship.

8. The door panel of claim 7 wherein said means for attaching adjacent, end-to-end connecting bars is a sliding connection formed between said connecting bars.

9. The door panel of claim 8 further comprising a plurality of alignment members providing for alignment between adjacent end-to-end subpanels.

10. The door panel of claim 9 wherein each alignment member comprises a junction cap having a plurality of oppositely extending protrusions and wherein adjoining ends of said subpanels include mating recesses for receiving said protrusions.

11. The door panel of claim 8 wherein said sliding connection is a telescopic sliding connection.

12. The door panel of claim 11 wherein the connecting bars include one end having a reduced cross sectional area with respect to an opposite end thereof to facilitate said telescopic sliding connection between adjoining connecting bars.

13. The door panel of claim 12 wherein said connecting bars are tubular.

14. The door panel of claim 1 further comprising a plurality of alignment members providing for alignment between adjacent end-to-end subpanels.

15. The door panel of claim 14 wherein each alignment member comprises a junction cap having a plurality of oppositely extending protrusions and wherein adjoining ends of said subpanels include mating recesses for receiving said protrusions.

16. A sectional door comprising:

a plurality of door panels and a plurality of hinges for securing one door panel to another, wherein each door panel includes:

a plurality of subpanels each subpanel forming a portion of an overall length of said door panel;

a plurality of connecting bars, said connecting bars each having a length substantially less than the overall length of said door panel; and, connector portions on each subpanel and each connecting bar for securing said connecting bars to adjacent subpanels placed end-to-end with said connecting bars extending in a lengthwise direction relative to said door panel.

17. The door of claim 16 wherein said connector portion of each subpanel and connecting bar respectively include a channel formed in each subpanel and an outer surface portion of each connecting bar which is received with a sliding frictional fit in said channel.

18. The door of claim 17 wherein said subpanels are of approximately equal length and each connecting bar has a length at least approximately equal to the length of a subpanel.

19. The door of claim 16 wherein said subpanels are of approximately equal length and each connecting bar has a length at least approximately equal to the length of a subpanel.

20. The door of claim 19 wherein each subpanel is between about two and six feet in length.

21. The door of claim 16 wherein each subpanel is between about two and six feet in length.

22. The door of claim 19 further comprising means for attaching adjacent connecting bars together generally in end-to-end relationship.

23. The door of claim 22 wherein said means for attaching adjacent, end-to-end connecting bars is a sliding connection formed between said connecting bars.

24. The door of claim 23 further comprising a plurality of alignment members providing for alignment between adjacent end-to-end subpanels.

25. The door of claim 24 wherein each alignment member comprises a junction cap having a plurality of oppositely extending protrusions and wherein adjoining ends of said subpanels include mating recesses for receiving said protrusions.

26. The door of claim 23 wherein said sliding connection is a telescopic sliding connection.

27. The door of claim 26 wherein the connecting bars include one end having a reduced cross sectional area with respect to an opposite end thereof to facilitate said telescopic sliding connection between adjoining connecting bars.

28. The door of claim 27 wherein said connecting bars are tubular.

29. The door of claim 16 further comprising a plurality of alignment members providing for alignment between adjacent end-to-end subpanels.

30. The door of claim 29 wherein each alignment member comprises a junction cap having a plurality of oppositely extending protrusions and wherein adjoining ends of said subpanels include mating recesses for receiving said protrusions.

31. A kit for constructing a sectional door, the kit comprising a plurality of door components contained in a package, the components including:

a plurality of subpanels, each subpanel forming a portion of an overall length of a door panel and at least one of said subpanels including a hinge support disposed at one edge thereof for hingedly mounting said door panel to an adjacent door panel;

a plurality of connecting bars, said connecting bars each having a length substantially less than the overall length of said door panel; and, connector portions on each subpanel and each connecting bar for securing said connecting bars to adjacent subpanels placed end-to-end with said connecting bars extending in a lengthwise direction relative to said door panel.

32. A method of making an overhead door panel having a length corresponding to the width of an overhead door, the method comprising the steps of:

a) providing a plurality of overhead door subpanels each having a length substantially less than a width of said overhead door and at least one of said subpanels having a hinge support disposed along one lengthwise edge thereof for hingedly mounting said door panel to an adjacent door panel;

b) providing a plurality of subpanel connecting bars each having a length substantially less than the width of said overhead door; and, c) rigidly connecting multiple subpanels together by securing at least one connecting bar between adjacent subpanels placed end-to-end with said connecting bar extending in a lengthwise direction relative to said overhead door panel.

33. The method of claim 32 wherein step (c) further comprises inserting said connecting bar into mating channels in adjacent subpanels.

34. The method of claim 33 further comprising the step of securing adjacent connecting bars together generally in end-to-end relationship.

35. The method of claim 34 wherein the step of securing adjacent connecting bars together further includes forming a telescopic connecting therebetween.

36. The method of claim 32 further comprising the step of aligning adjacent subpanels with respect to one another with a plurality of alignment members, each alignment member being disposed between a pair of adjacent subpanels.

37. The method of claim 36 wherein said alignment members receive said connecting bars.

38. A method of making an overhead door from a plurality of door panels having a length corresponding to the width of the overhead door, the method comprising the steps of:

a) providing a plurality of overhead door subpanels each having a length substantially less than the width of said overhead door;

b) providing a plurality of subpanel connecting bars each having a length substantially less than the width said overhead door;

c) forming a plurality of door panels by rigidly connecting multiple subpanels together, wherein each door panel is formed by securing at least one connecting bar between adjacent subpanels placed end-to-end with said connecting bar extending in a lengthwise direction relative to said door panel; and d) connecting said plurality of overhead door panels together by hinges disposed between adjacent door panels.

39. The method of claim 38 wherein step (c) further comprises inserting said connecting bar into mating channels in adjacent subpanels.

40. The method of claim 39 further comprising the step of securing adjacent connecting bars together generally in end-to-end relationship.

41. The method of claim 40 wherein the step of securing adjacent connecting bars together further includes forming a telescopic connecting therebetween.

42. The method of claim 38 further comprising the step of aligning adjacent subpanels with respect to one another with a plurality of alignment members, each alignment member being disposed between a pair of adjacent subpanels.

43. The method of claim 42 wherein said alignment members receive said connecting bars.

* * * * *